US010337195B1

(12) United States Patent
Langkilde et al.

(10) Patent No.: US 10,337,195 B1
(45) Date of Patent: Jul. 2, 2019

(54) CONTAINMENT SHEETING MOUNTING SYSTEM

(71) Applicants: Jacob A. Langkilde, San Marcos, CA (US); Dale A. Langkilde, San Marcos, CA (US)

(72) Inventors: Jacob A. Langkilde, San Marcos, CA (US); Dale A. Langkilde, San Marcos, CA (US)

( * ) Notice: Subject to any disclaimer, the term of this patent is extended or adjusted under 35 U.S.C. 154(b) by 0 days.

(21) Appl. No.: 15/985,209

(22) Filed: May 21, 2018

(51) Int. Cl.
*E04G 21/30* (2006.01)
*B05B 12/24* (2018.01)
*E04G 21/24* (2006.01)

(52) U.S. Cl.
CPC ..... *E04G 21/30* (2013.01); *B05B 12/24* (2018.02); *E04G 21/242* (2013.01)

(58) Field of Classification Search
CPC ..... E04G 21/30; E04G 21/242; B05B 12/24
See application file for complete search history.

(56) References Cited

U.S. PATENT DOCUMENTS 4,201,799 A * 5/1980 Stephens ..... C09J 7/21 427/142
4,263,347 A * 4/1981 Banta ..... E04G 21/30 427/282
4,313,970 A * 2/1982 Jones ..... B05B 12/24 427/557
5,654,055 A * 8/1997 Cox ..... B05B 12/40 428/41.7
5,776,572 A * 7/1998 Lipson ..... B05B 12/24 428/40.1
5,843,011 A * 12/1998 Lucas ..... A61F 13/023 602/57
8,877,311 B1 * 11/2014 Avila ..... B05B 12/20 428/40.1
2008/0216946 A1 * 9/2008 White ..... C09J 7/20 156/230
2009/0202773 A1 * 8/2009 Burgoon ..... B05B 12/24 428/42.2
2011/0265961 A1 * 11/2011 von Gonten ..... E04G 21/30 160/330
2011/0281079 A1 * 11/2011 Kim ..... C09J 7/38 428/172
2017/0183884 A1 * 6/2017 Rus ..... E04G 21/30
2017/0335140 A1 * 11/2017 Nardone ..... E04G 21/30
2018/0117616 A1 * 5/2018 Lopez, Jr. ..... B05B 12/24

FOREIGN PATENT DOCUMENTS

DE 20215206 U1 * 12/2002 ..... B05B 12/24
EP 0761907 A1 * 3/1997 ..... E04G 21/30
JP 3934711 B2 * 6/2007

OTHER PUBLICATIONS

Translation for JP3934711(B2) (Year: 2007).*

* cited by examiner

*Primary Examiner* — Jeanette E Chapman
(74) *Attorney, Agent, or Firm* — Donn K. Harms

(57) ABSTRACT

A containment sheet mounting device for holding containment sheeting in a sealed engagement to a mounting surface. The device has a base which is removably engageable to the mounting surface which has one or a pair of connecting members extending from the base. The connecting members have an adhesive surface which engages with the sides of the containment sheeting to hold it in position adjacent the mounting surface.

12 Claims, 6 Drawing Sheets

CONTAINMENT SHEETING MOUNTING SYSTEM

BACKGROUND OF THE INVENTION

1. Field of the Invention

The present invention relates to the installation of plastic and similar sheeting for containment of dust, overspray, and other airborne particles. More particularly, the invention relates to a mount employable to sealably engage perimeter edges of containment sheeting to a support surface such as a wall, ceiling, floor, or other indoor surfaces.

2. Prior Art

In the fire, flood, abatement, and other construction and remediation industries, there is an ongoing requirement to seal indoor rooms and areas to prevent particulate, overspray, and other airborne contaminants, from migrating from one area of the building or room, to other areas of the room or building. For example, during asbestos removal, it is a requirement that work areas of a building be sealed from air communication with other areas of the building or the exterior of the building. There is a similar need and requirement for such containment where for example sound buffering material known as "popcorn" is removed from ceiling areas. Another such task where the prevention of the communication of particulate and overspray is required is that of spray painting in a building or section thereof.

Conventionally, the prevention of the communication of airborne particles and overspray is accomplished by the positioning of containment sheeting in a vertical or horizontal disposition within rooms of the building. Such containment sheeting may be plastic sheeting, for example polyethylene or polyurethane which is 1 mil to 50 mils thick. In some instances such containment sheeting may be polymeric coated or laminated textile fabric or scrims, which while significantly heavier than plastic sheeting, provides a significantly stronger containment sheet. In a current mode of the industry, tape is engaged over perimeter edges of plastic sheeting and the adjacent wall or ceiling surfaces to thereby form a sealed perimiter engagement of the sheeting with the interior of the room or other building area.

Because of the need to form a very good, if not leak-proof seal between the plastic sheeting edges and the adjacent wall or ceiling or floor or the like, the proper positioning of such sheeting to prevent airborn contaminants from leaving an area is extremely time consuming. Conventional methods and material employed for this take uses two or more types of adhesive tape to protect, hold, seal and help separate a work area from a separated area. This tape engagement method requires a time consuming effort by one or generally multiple employees who must take multiple steps to engage multiple layers of adhesive tape in various fashions to seal the perimiter edges of plastic sheeting to form the air barrier. Each layer of tape applied takes additional employee time and constantly results in delays for construction and abatement projects in addition to the significant wage cost for the multiple employees who must be present and working to accomplish the sealing task. Even with such an expenditure of time labor and funds, because of the multiple steps and multiple layers of adhesive tape attached by multiple different employees, there is a constant problem with poor sealing caused by inexperienced or inattentive employees forming the barrier.

The device and system herein disclosed, provides an easy manner for experienced and inexperienced employees forming an air barrier with plastic sheeting, to quickly and securely engage the perimeter edges of plastic sheeting to adjacent surfaces. Using a single-edge or multiple-edge engagement device which may be provided in rolls or linear sections, the workers can form an extremely strong and sealed engagement of the perimeter edges of such plastic sheeting to the adjacent surfaces of a building or structure. Such, not only forms a significantly enhanced engagement and seal of the plastic sheeting to prevent airflow contamination, but additionally provides for significant decrease in the labor and hours required by employees and the cost thereof.

The forgoing examples of plastic sheeting engagement for the noted projects and reasons and the limitations related therewith, are intended to be illustrative and not exclusive. The disclosed examples and background do not imply any limitations whatsoever on the invention described and claimed herein. Various other limitations of the related art of sheeting engagement for containment are known, or such will become apparent to those skilled in the art upon a reading and understanding of the specification below and the accompanying drawings.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements. By "substantially" is meant plus or minus ten percent.

It is an object of the present invention to provide a containment sheeting mounting system which is easily engaged in a minimum of steps with a minimum of work required by users.

It is a further object of the present invention to provide such a containment sheeting mounting system which not only improves on the speed which such sheeting may be installed, but also improves on the installation itself by rendering it better sealed against leaks.

These and other objects, features, and advantages of the invention herein disclosed, as well as the advantages thereof over existing prior art, which will become apparent from the description to follow, are accomplished by the improvements described in this specification and hereinafter described in the following detailed description, which fully discloses the invention, but should not be considered as placing limitations thereon.

SUMMARY OF THE INVENTION

The containment sheeting mounting device and method herein disclosed and described overcomes the shortcomings in the prior art, while enhancing the actual installation to better resist leaking once installed. In all modes of the containment sheeting mounting device herein, there is included a base which is flexible. The base is adapted for engagement to a mounting or support surface within a building or room such as a ceiling, wall, support beam, or other surface therein.

The base is provided with a means for removable engagement of the base to the support surface. In the preferred mode of the system herein this is provided by an adhesive coating on a first surface of the base, which removably engages with the support surface. Preferably where the adhesive coating is positioned on the base, a flexible and easy to remove covering layer is positioned in operative engagement with the adhesive coating. Such a configuration is known as a "peel and stick" configuration where the flexible covering layer may be pulled from its attachment to the adhesive.

Additionally in all modes of the device herein, at least one flexible connecting member extends from a first end thereof attached to the base, to a distal end of the connecting member. Each such flexible connecting member has an adhesive coating thereon which is initially covered by a removable flexible covering layer placed thereover similar to that of the base. In use, the covering layer is removed from the connecting member which thereby exposes the adhesive coating. Once exposed, the adhesive coating is employable to engage to a perimiter edge of the containment sheeting being used in combination with the device herein.

The size of the base can vary in different modes of the device shown herein, however in a most preferred mode of the base, the first end of the connecting member is substantially in a center area of the base, inbetween the two side edges of the base. This mode provides a secure engagement of the base to the support surface using the widest area of an adhesive coating on the first surface of the base, and positions the sheeting extending from a central area of the base.

Other depicted configurations of the base are shown which are narrower or have the first end of the flexible connecting member extending from or adjacent one of the side edges of the base. In some situations the narrower base may be an advantage such as in confined area or on support beams or headers, and it is envisioned within the scope of this patent that multiple of the depicted and described configurations of the device herein may be employed on a job site.

As noted, extending from a first end engagement to the base, is at least one flexible connecting member which has an adhesive surface positioned thereon allowing for engagement of the connecting member to a side surface of the containment sheeting being mounted. As shown in all modes, the adhesive surface positioned on the one or plurality of flexible connecting members is covered by an easily removable covering layer in a "peel and stick" configuration. This allows the user to engage one of the base or the connecting member to a surface without having the other of the base or connecting member having its adhesive exposed which would cause the user trouble.

In a particularly preferred mode of the device herein, two connecting members extend from respective first ends thereof engaged with the base. On sides of each of the two facing sides of the connecting members is positioned an adhesive layer having a peelable or otherwise removable covering layer. In use, the user may remove the covering layer from the adhesive coating on both of the two facing sides of the two connecting members, and thereafter place the edge of the containment sheeting in a sandwiched engagement securely adhesively engaged with and in-between both of the two flexible connecting members. This mode of the device has shown to yield a very secure connection to the containment sheeting as well as an excellent seal therewith. It also offers increased support from that of a single connecting member engagement and is adapted to better support heavier containment sheeting.

Another preferred mode of the device disclosed herein, provides a base formed of a material adapted not to tear when a fastener such as a staple is employed to secure the base to an underlying support surface. This mode of the device may be employed in situations where there is high wind or constant impacts or worker contact with the containment sheeting being held in place. A fabric scrim or mesh or the like would be included as a layer or component in the base, to prevent tearing or dismounting once a piercing fastener such as a staple is engaged therethrough. The fastener-engaged base may also include adhesive employable with the fasteners, to give the user an easy manner to initially install the base, and to enhance the air seal between the support surface and the base.

The containment sheeting mounts herein can be provided in elongated sections which may be assembled around containment sheeting being mounted or may also be provided in rolls where desired lengths of the containment sheeting mount can be cut from the roll according to need.

With respect to the above description of the device herein and method of employment therefor, before explaining at least one preferred embodiment of the herein disclosed containment sheeting mounting system invention in detail, it is to be understood that the invention is not limited in its application, to the details of construction and to the arrangement of the components of the device, nor the steps in any disclosed method, in the following description or illustrated in the drawings. The invention herein described is capable of other embodiments and of being practiced and carried out in various ways which will be obvious to those skilled in the art upon reading this disclosure. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other devices, structures, methods and systems, for carrying out the secure and sealed mounting of containment sheeting and the several purposes of the present disclosed device and method herein. It is important, therefore, that the claims be regarded as including such equivalent construction and methodology insofar as they do not depart from the spirit and scope of the present invention.

BRIEF DESCRIPTION OF DRAWING FIGURES

The accompanying drawings, which are incorporated herein and form a part of the specification, illustrate some, but not the only or exclusive examples of embodiments and/or features of the containment sheeting mounting device. It is intended that the embodiments and figures disclosed herein are to be considered illustrative of the invention herein, rather than limiting in any fashion.

DETAILED DESCRIPTION OF THE PREFERRED

Embodiments of the Invention

Figure 1:
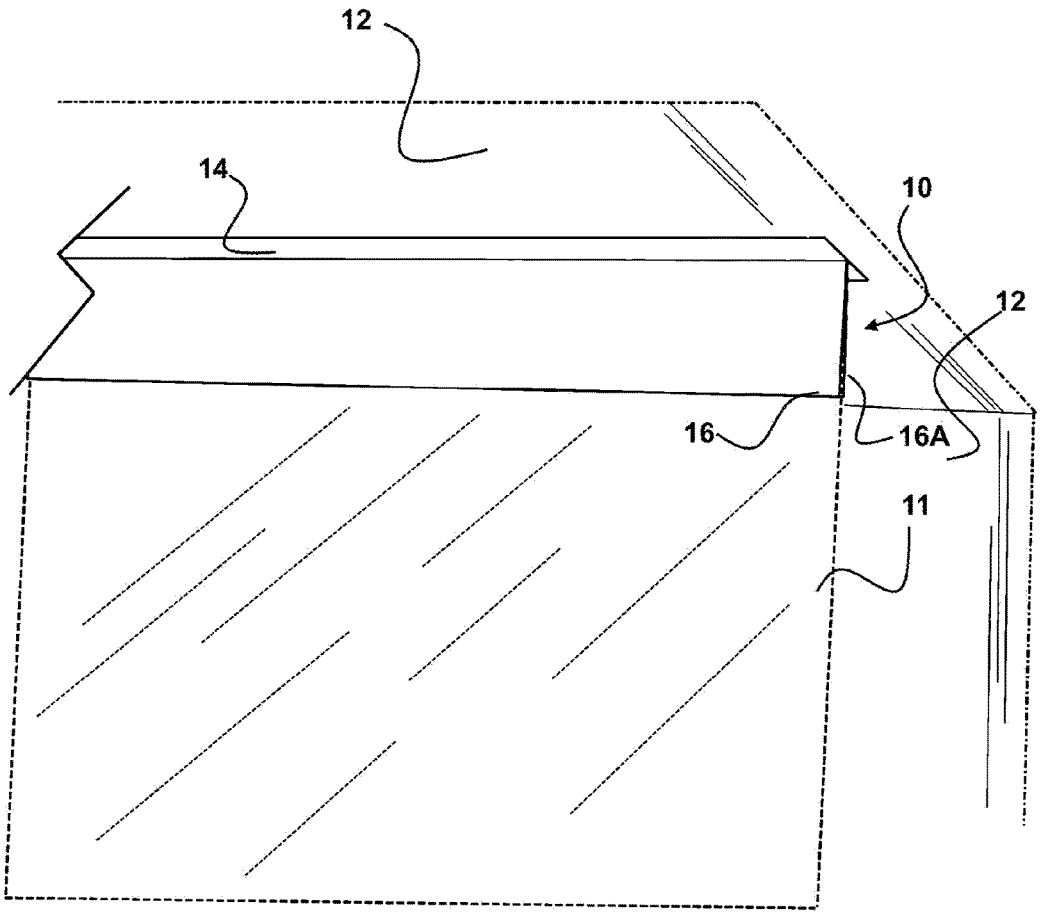
FIG. 1 depicts the containment sheeting mounting device herein showing a base operatively engaged with an overhead surface and a pair of connecting members extending from the base connected with a sheet of plastic material.

Referring now to the drawings of FIGS. 1-12 which depict modes of the device 10 and method herein there is shown in FIG. 1, the containment sheeting 11 mounting device 10, operatively engaged with a support surface 12 such as a ceiling or wall surface. The mounting device 10 is shown with a base 14 having a first side surface operatively removably engaged with an overhead or a vertical support surface 12, however the base 14 of the device 10 herein is adapted to removably engage a first surface of the base 14 against any support surface 12, be it over, under, or on sides of the containment sheeting 11 to which the device 10 engages.

The base 14 in all modes of the device 10 shown and described herein employs a removable fastener to engage a first side of the base 14 against the support surface 12. This removable fastener preferably is one or a combination of removable fasteners from a group of removable fasteners including an adhesive surface 18 (FIG. 2) or a piercing fastener 26 such as in FIGS. 10-11.

Figure 2:
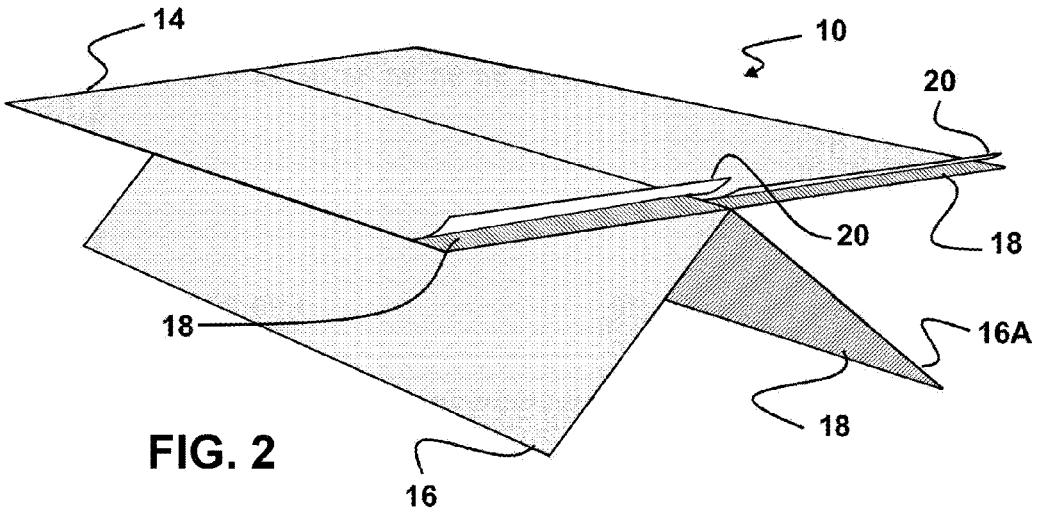
FIG. 2 shows one mode of the device herein wherein the base has adhesive on a first side adapted to adhesively engage with a support surface and a pair of connecting members each have adhesive thereon exposed after removal of a covering layer.
Figure 5:
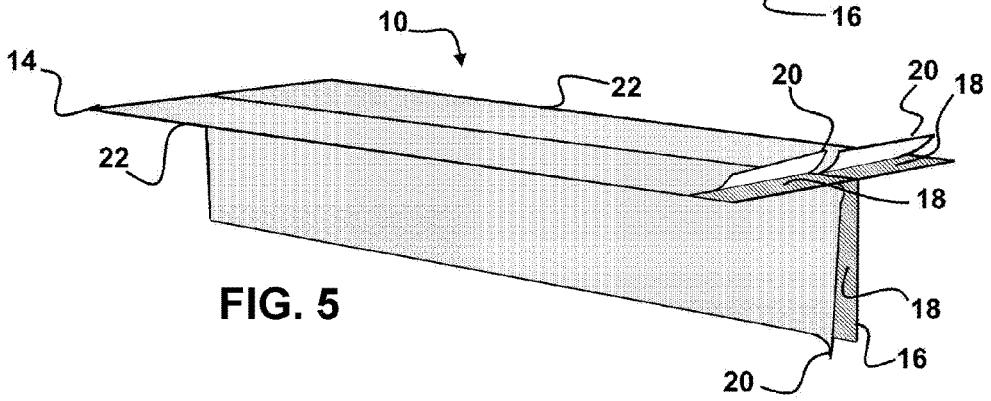
FIG. 5 depicts the device as in FIG. 4 showing the removable layers covering the first side of the base and one side of the connecting member.
Figure 7:
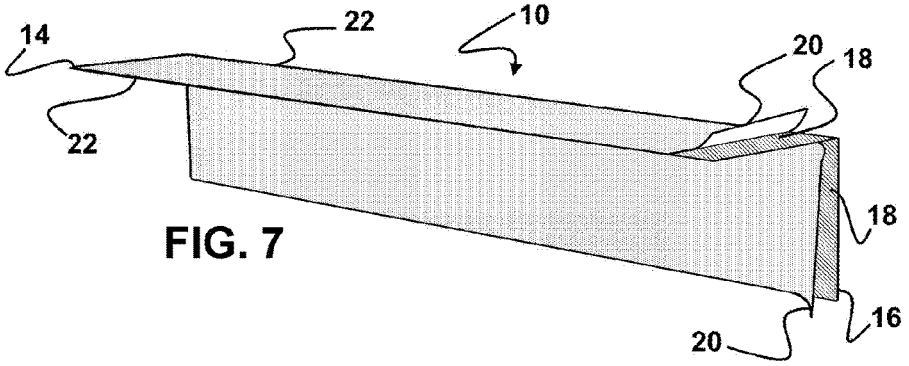
FIG. 7 shows the device as in FIG. 6 depicting the removable layers being peeled from their engagement over adhesive surfaces on each.

As also shown in FIG. 1, and other figures herein, at least one connecting member 16, or as shown in some modes, first and second connecting members 16, extend from a first end thereof connected with the second side of the base 14. In all modes of the device 10 herein, at least one connecting member 16 OR 16A engages with the containment sheeting 11. As shown in FIGS. 2,5, and 7 for example, connecting member 16 or members or 16 and 16A have an adhesive surface 18 thereon, which prior to use on the job site, would be covered by a removable layer 20 such as the peel and stick type of flexible covering well known in the art.

Figure 3:
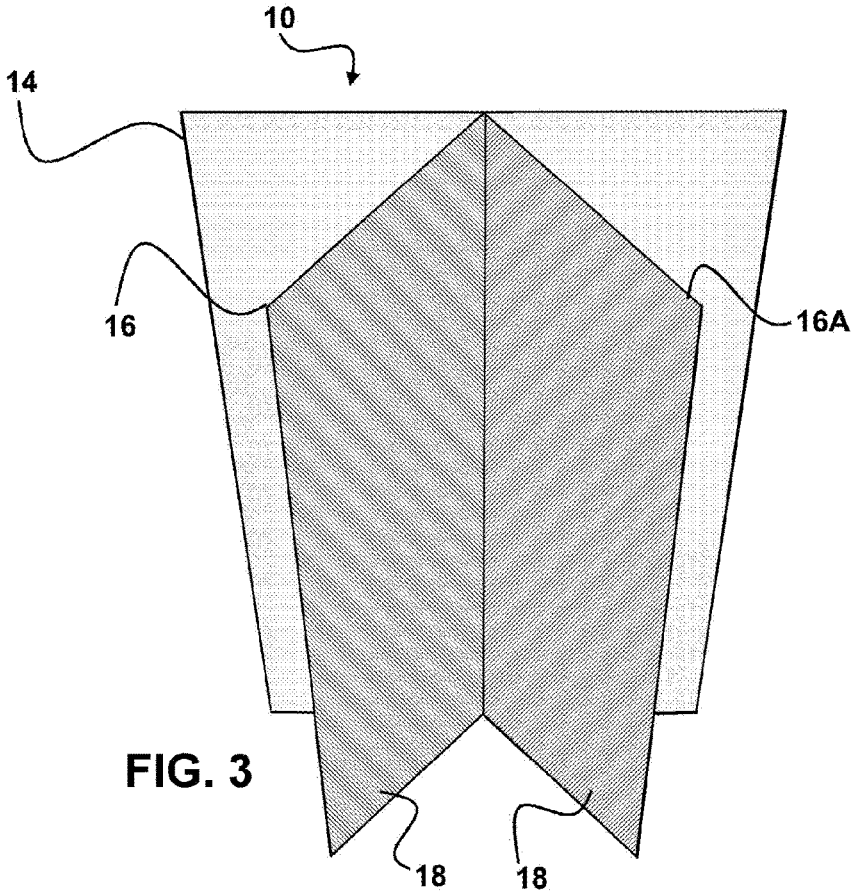
FIG. 3 shows a view of the device as in FIG. 2 from a perspective below the two opposing connecting members.
Figure 12:
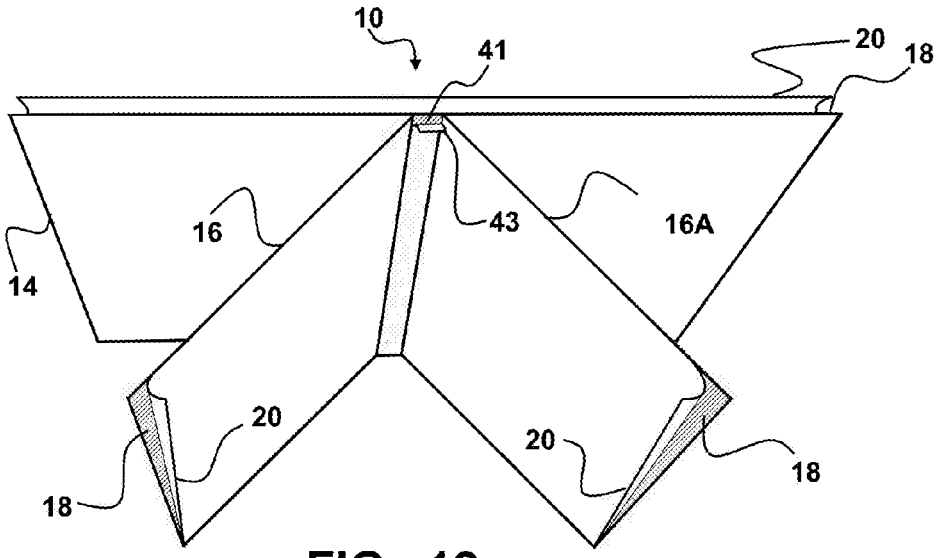
FIG. 12 depicts a particularly preferred mode of the device herein having a centrally located adhesive strip for initial positioning of sheeting between the first and second connecting members prior to engagement therebetween.

In FIGS. 2 and 3 is shown a preferred mode of the device 10 which as shown has an adhesive surface 18 on a first side of the base 14 which as noted prior to use is covered by a removable layer 20. As shown, once the removable layer 20 is peeled from the adhesive surface 18 on the first side of the base 14 is may be mounted to a support surface 12 as shown in FIG. 1. FIGS. 2-3 are substantially the same configuration and mode of the device as FIG. 12 which includes an extra centrally located adhesive strip 41 as shown in FIG. 12. Additionally as noted, the device 10 in FIGS. 4-7 operates in the same fashion as that of FIGS. 2-3 however only one connecting member 16 is employed which in some installations may be sufficient.

As also noted herein, the adhesive strip 41 can be positioned adjacent the basic mode of the device 10 with only a single connecting member 16 and provide the user the ability to pre-position the containment sheeting 11 upon the adhesive strip 41 and subsequently peel and engage the connecting member 16 in the mode with only one connecting member 16.

As depicted in FIG. 2, two separate removable layers 20 may be used to cover the adhesive surface 18 on the base 14. In experimentation it was found unexpendedly that on many occasions the base 14 may need to mount on a corner of a projecting wall or beam. In such installations, having two separate removable layers 20 the user can more easily engage a portion of the first side of the base 14 to a first support surface and the other portion of the first side of the base 14 to a second support surface which is running at an angle or perpendicular to the first support surface.

In FIG. 3 which shows the device 10 of FIG. 2 from a perspective view below the two flexible opposing connecting members shown as first connecting member 16 and second connecting member 16A. In this view the removable layer 20 as in FIG. 2, has already been peeled or otherwise removed from the facing surfaces of both a first connecting member 16 and the adjacent second connecting member 16A. Once the user has the base 14 engaged with the desired support surface 12, the containment sheeting 11 shown in FIGS. 1 and 8, can be engaged with both of the connecting members 16 and 16A in a sandwiched adhesive engagement therebetween. The base 14 is adapted to engage with the support surface 12 by removing the removable layer 20 from the adhesive surface 18 and engaging the adhesive to the support surface 12 although a fastener as noted below may also be employed.

Figure 4:
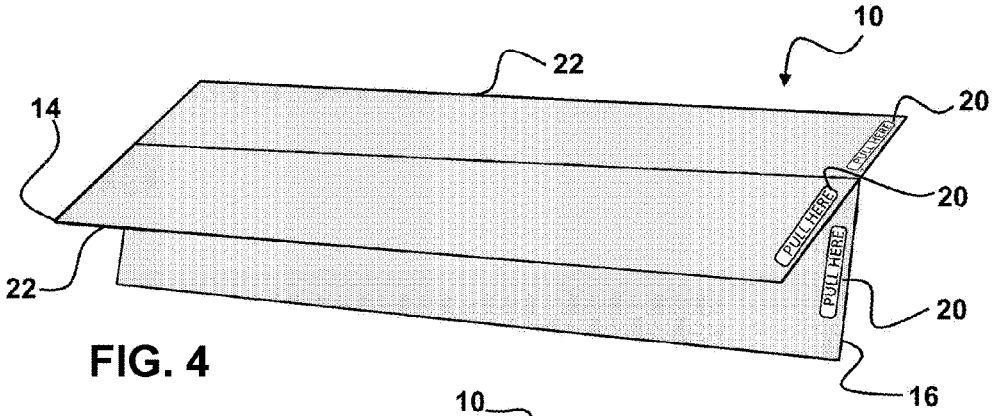
FIG. 4 depicts a view of the device similar to that of FIG. 1 but having a base with a removable layer covering an adhesive coating and having a single connecting member extending from the base which has adhesive thereon which is covered by a removable layer.

Shown in FIGS. 4-5 is another view of a mode of the device 10 herein, similar to that of FIGS. 1-3, but having a base 14 wherein on the first side of the base 14 there is a removable layer 20 covering an adhesive surface 18 thereunder, and a single connecting member 16 extending from the second side of the base 14. The second side of the base 14 in all modes has either one or a plurality of connecting members 16 extending therefrom. As shown, the single or a first connecting member 16 has an adhesive surface 18 on a single side thereof which as shown in FIG. 4 faces the base 14. This adhesive surface 18 on the first connecting member 16 as well as the second connecting member 16A when employed, is covered by a removable layer 20 which as shown in FIG. 5, may be peeled to expose the adhesive surface 18.

Figure 6:
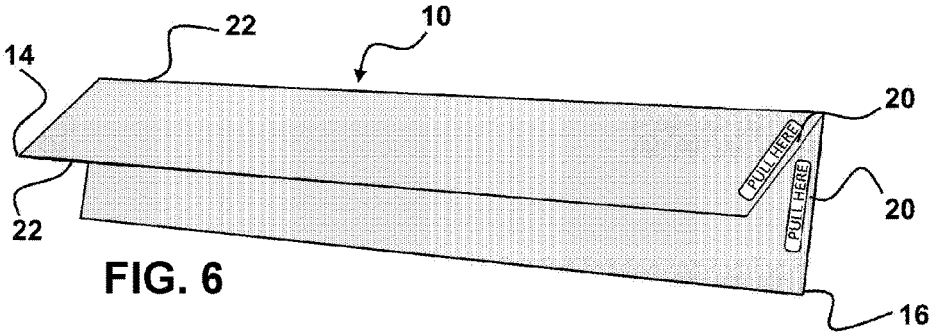
FIG. 6 shows a mode of the device herein wherein the connecting member extends from a side edge of the base and both have adhesive surfaces covered by removable layers placed thereover.

FIGS. 6-7 depict another preferred mode of the device 10 herein wherein a single or first connecting member 16 extends from engagement at one end thereof with the base 14 along one side 22 edge of the base 14. The first connecting member 16 and second connecting member 16A shown in other modes, both are connected to the base 14 at first ends thereof and extend to a distal end.

This mode of the device 10 shown in FIGS. 6-7 employs a smaller base 14 and may not be effective for use with a heavy containment sheeting 11. As shown, the first side of the base 14 has the removable layer 20 which when peeled back will expose the adhesive surface 18 such as shown in FIG. 7. The single or first connecting member 16 also has a similar removable layer 20 covering the adhesive surface 18 thereon. Such peel and stick adhesive and removable layer configurations are well known in the art.

Figure 8:
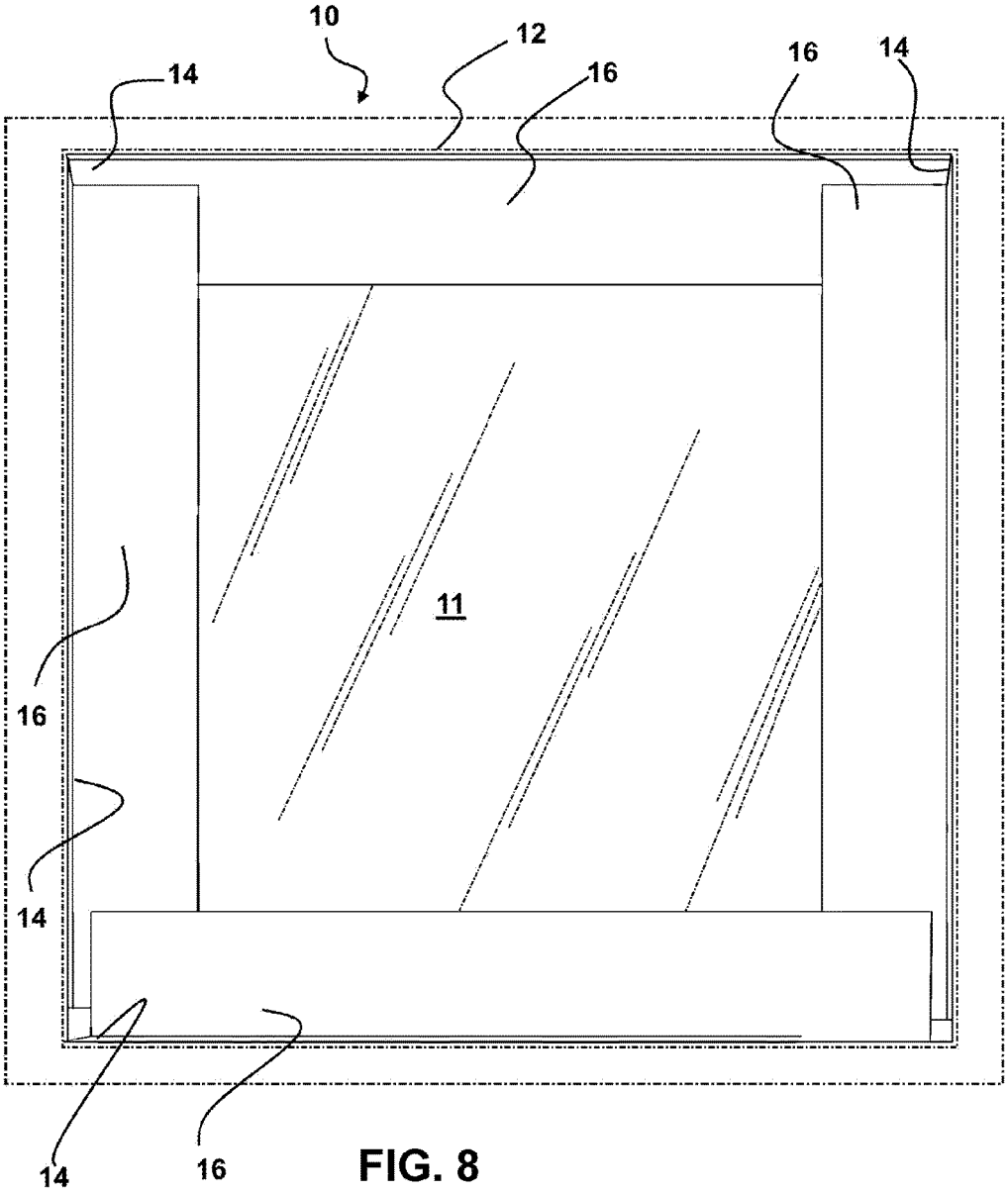
FIG. 8 depicts an installation of containment sheeting such as plastic or similar material which is engaged around a perimeter edge with the strips of the device herein which are engaged to support surfaces in building.

Shown in FIG. 8 is an example of an installation of containment sheeting 11, which should not be considered limiting in any fashion but is shown for an understanding that the device herein 10 formed to sections is engageable around the perimeter of the containment sheeting 11 by engagement of the connecting members 16 projecting from a base 14. Each base 14 in each section is operatively engaged with a support surface by the adhesive surface 18 positioned on a first side of the base 14.

Figure 9:
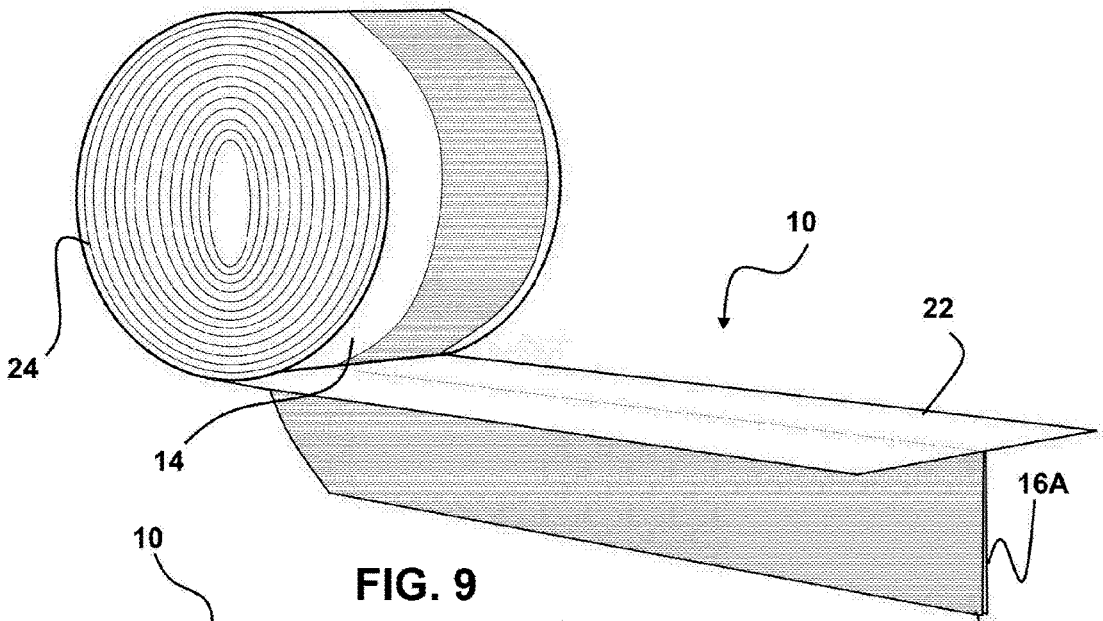
FIG. 9 shows a depiction of any mode of the containment sheeting mounting device disclosed herein showing it is formable to roll allowing users to cut sections to size for use on a job site.

As shown in FIG. 9 the device 10 herein, when not provided in precut sections such as shown in FIG. 8, the device 10 in all modes shown in the drawings and described herein, can also be provided in a roll 24. Such will allow users on site to cut sections of the mounting device 10 to lengths of the base 14 and engaged connecting members 16 appropriate for the task at hand.

Figure 10:
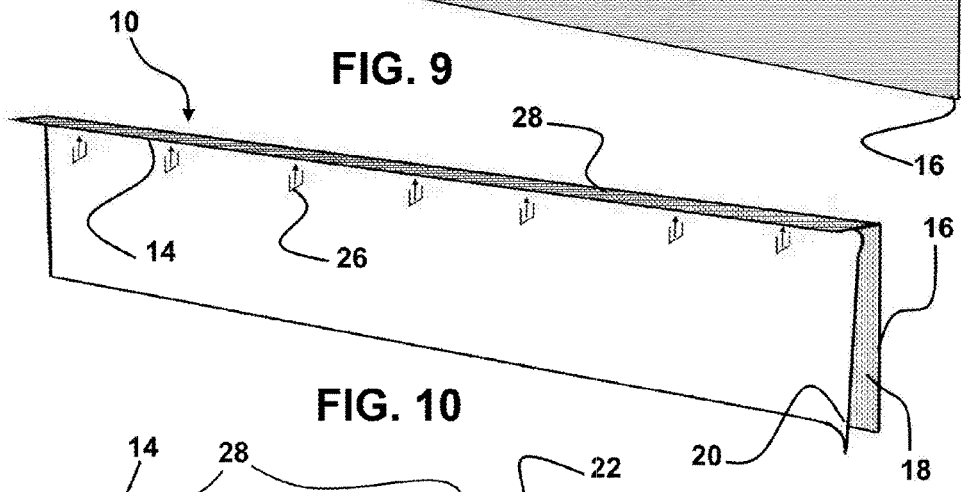
FIG. 10 shows another mode of the containment sheeting mounting device herein, wherein the base engages to support surfaces with fasteners such as staples or nails and the connecting member extends therefrom.

Shown in FIG. 10 is another mode of the containment sheeting mounting device 10 herein. The base 14 is configured to engage to support surfaces 12 such as in FIG. 1 or 8, with piercing fasteners 26 which are inserted through the base 14 instead of, or in combination with, an adhesive surface 18 on the first side of the base 14. Such piercing fasteners may be, for example, nails, staples, screws, brads, or any other piercing fastener which someone skilled in the art would employ. When using such piercing fasteners 26 it is preferred that the base 14 be reinforced with a scrim 28 formed of woven or non woven textile or fabric or webbing such as screen, which is engaged to laminated in a layered configuration within the material forming the base 14.

Experimentation found that without such scrim 28 reinforcement, the base 14, when formed of paper or polymeric or other material such as TYVEK, can be pulled from piercing fasteners 26 causing rips or openings in the base 14. However, with a mesh scrim 28 adhered to or under the first side of the base 14 such as by lamination between a multi-layer base 14, the piercing fasteners 26 stay mounted into the base 14 even under pressure pulling the base 14 away from the underlying support surface. As noted in FIG. 11, the scrim 28 can be included across the entire area of the base 14 which is easily done in a multi layer laminated configuration of the base 14.

Figure 11:
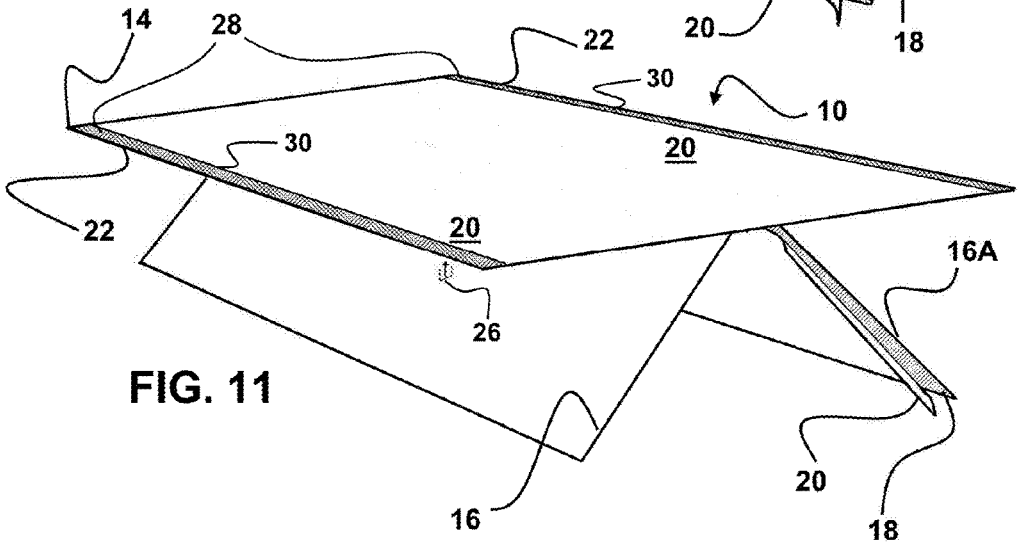
FIG. 11 shows a mode of the mounting device herein, wherein a reinforced gap on the base running between the two connecting members is provide for fastener engagement and where adhesive is positioned under removable layers on either side of the gap and on both connecting members.

In FIG. 11 is depicted another favored mode of the mounting device 10 herein, wherein the scrim 28 reinforced section 30 is positioned on or within the base 14 in viewable sections 30 which provide the user a target for the piercing fasteners 26 such as with a staple gun. In use, the sections 30 are visually discernable to a user either by colorizing the material of the base 14 along the line of the scrim 28 or by having the scrim 28 exposed along the section 30.

While shown as two scrim 28 reinforced sections 30, the scrim 28 reinforcing fabric such as netting, or screen, or textile fibers or other woven or non woven reinforcement, as noted above may be included throughout the base 14. The first connecting member 16 and second connecting member 16A members run parallel in their respective engagement at first ends to the base 14, and extend therefrom to distal ends in the same manner as shown in other modes. With the scrim 28 fabric reinforcing in sections 30 or all of the base, piercing fasteners 26 can be employed through the material of the base 14 and through the scrim 28 to enhance engagement of the base 14 to an underlying support surface. Removable layers 20 once peeled away, will reveal the underlying adhesive surface 18 on both the base 14 and the connecting members 16.

Shown in FIG. 12, is a particularly preferred mode of the device 10 which is configured the same as the device 10 in FIGS. 1-3, but additionally includes centrally positioned secondary adhesive surface 41, covered by a centrally located release layer 43, which is positioned on the second side of the base 14, between the two first connecting member 16 and second connecting member 16A. The device in FIG. 12 operates substantially the same as that described above for that of FIGS. 1-3, but includes additional utility provided by a centrally located secondary adhesive surface 41 during the initial installation of the containment sheeting 11 as shown in FIG. 1.

In use in the same fashion as FIG. 1-3, the user removes the removable layer 20 covering the first side of the base 14 and may adhere the base 14 using the adhesive surface 18 to a mounting surface 12. Once the base 14 is engaged to a mounting surface 12 such as a wall or ceiling or the like, in this mode, the user may remove the centrally located release layer 43 exposing the centrally located secondary adhesive surface 41.

This centrally located secondary adhesive surface 41 so exposed, allows the user to pre-position the containment sheeting 11 such as shown in FIG. 1, in adhesive engagement with the centrally located adhesive in-between the two flexible opposing first and second connecting members 16 and 16A, before the adhesive surface 18 on the facing surfaces of the opposing connecting members 16 and 16A is exposed. It works especially well to allow a single user to easily first position the base 14 on a support surface 12 and then position the containment sheeting 11 in a first step in adhesive engagement with the centrally located secondary adhesive surface 18. Thereafter with the sheeting 11 temporarily held in place, they may peel the removable layers 20 from the opposing first and second connecting members 16 and 16A with the sheeting 11 held in place by the centrally located secondary adhesive surface 18, and form a sealed engagement therewith. This mode of the device is particularly preferred in that it allows a single user to easily form a containment shield in a room or area.

It should be noted that while not shown in the drawings, this centrally located secondary adhesive surface 41 and release layer 43, can be included with the modes of the device 10 adjacent the first end of an engaged first connecting member 16 as in FIGS. 4-7, to provided for pre positioning of the containment sheeting 11. Thereafter the user can seal against the sheeting 11 with a single connecting member 16, and such is considered included herein.

While all of the fundamental characteristics and features of the containment sheet mount invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A containment sheet mounting apparatus, comprising:

a flexible base having a first side opposite a second side;

a removable fastener adapted for securing said first side of said base to a support surface;

a connecting member, said connecting member being flexible, said connecting member extending from a first end thereof in an engagement with said second side of said base, to a distal end thereof;

said connecting member having an adhesive surface thereon covered by a removable layer;

said connecting member comprising a flexible first connecting member portion and a flexible second connecting member portion;

said first connecting member portion having a first end thereof in said engagement with said second side of said base, and extending therefrom to said distal end thereof;

a first area of said adhesive surface covered by a first section of said removable layer being positioned on a first side surface of said first connecting member portion;

said second connecting member portion having a first side surface opposite a second side surface, said second connecting member portion extending from a first end thereof in said engagement with said second side of said base, to a distal end thereof;

said first side surface of said second connecting member portion facing said first side surface of said first connecting member portion;

said first side surface of said second connecting member portion having a second area of said adhesive surface thereon covered by a second section of said removable layer; and whereby, with said first side of said base held in contact with said support surface by said removable fastener, said adhesive surface of said connecting member is adapted to form an adhesive engagement to containment sheeting to hold it adjacent said base in a sandwiched engagement between said first connecting member portion having said first area of said adhesive surface thereof engaged with a first side of said containment sheeting and said second connecting member portion having said second area of said adhesive surface engaged with a second side of said containment sheeting.

2. The containment sheet mounting apparatus of claim 1 wherein said removable fastener is one or a combination of removable fasteners from a group including an adhesive surface positioned on said first side of said base and a piercing fastener.

3. The containment sheet mounting apparatus of claim 1 wherein said removable fastener is a secondary adhesive surface positioned on said first side of said base covered by a removable layer.

4. The containment sheet mounting apparatus of claim 1 additionally comprising:

a secondary adhesive area positioned on said second side of said base;

said secondary adhesive area positioned along said second side of said base for a length thereof running adjacent said engagement of said first end of said connecting member to said second side of said base, said secondary adhesive surface covered by a secondary removable layer.

5. The containment sheet mounting apparatus of claim 2 additionally comprising:

a secondary adhesive area positioned on said second side of said base;

said secondary adhesive area positioned along said second side of said base for a length thereof running adjacent said engagement of said first end of said connecting member to said second side of said base, said secondary adhesive surface covered by a secondary removable layer.

6. The containment sheet mounting apparatus of claim 3 additionally comprising:

a secondary adhesive area positioned on said second side of said base;

said secondary adhesive area positioned along said second side of said base for a length thereof running adjacent said engagement of said first end of said connecting member to said second side of said base, said secondary adhesive surface covered by a secondary removable layer.

7. The containment sheet mounting apparatus of claim 1 additionally comprising:

a reinforcing scrim positioned on said base.

8. The containment sheet mounting apparatus of claim 2 additionally comprising:

a reinforcing scrim positioned on said base.

9. The containment sheet mounting apparatus of claim 3 additionally comprising:

a reinforcing scrim positioned on said base.

10. The containment sheet mounting apparatus of claim 4 additionally comprising:

a reinforcing scrim positioned on said base.

11. The containment sheet mounting apparatus of claim 5 additionally comprising:

a reinforcing scrim positioned on said base.

12. The containment sheet mounting apparatus of claim 6 additionally comprising:

a reinforcing scrim positioned on said base.

* * * * *